US006065268A

United States Patent [19]

Gump

[11] Patent Number: 6,065,268

[45] Date of Patent: May 23, 2000

[54] FLOOR JACK COVERING DEVICE

[76] Inventor: Duane E. Gump, R.R. 5 Box 43, Moundsville, W. Va. 26041

[21] Appl. No.: 09/089,348

[22] Filed: Jun. 3, 1998

Related U.S. Application Data

[60] Provisional application No. 60/049,119, Jun. 10, 1997.

[51] Int. Cl.[7] ..... E04C 3/30

[52] U.S. Cl. ..... 52/737.4; 52/731.3; 52/732.3; 52/738.1; 52/301; 52/736.2

[58] Field of Search ..... 52/737.4, 731.3, 52/731.4, 732.1, 732.3, 730.5, 296, 721.4, 721.7, 720.1, 738.1, 301, 736.2, 736.3; 138/159, 162, 166

[56] References Cited

U.S. PATENT DOCUMENTS

| | | | |
|---|---|---|---|
| 162,999 | 5/1875 | Cornell | 138/159 X |
| 1,350,686 | 8/1920 | Trudelle | 52/737.4 X |
| 1,804,320 | 5/1931 | Cross | 52/721.4 X |
| 3,196,495 | 7/1965 | Owen | 52/737.4 X |
| 3,276,182 | 10/1966 | Handley | 52/732.3 |
| 3,727,363 | 4/1973 | Kinsey | 52/731.4 |
| 3,998,028 | 12/1976 | Pelletier et al. . | |
| 4,019,301 | 4/1977 | Fox | 52/721.7 |
| 4,467,584 | 8/1984 | Crites et al. . | |
| 4,606,167 | 8/1986 | Thorne . | |
| 4,961,258 | 10/1990 | Menzel . | |
| 5,150,554 | 9/1992 | Quinlan et al. | 52/720.1 X |
| 5,335,471 | 8/1994 | Kupiec . | |
| 5,605,023 | 2/1997 | Biernazki | 52/737.4 X |
| 5,864,998 | 2/1999 | Loomer | 52/738.1 X |

*Primary Examiner*—Carl D. Friedman
*Assistant Examiner*—Winnie Yip
*Attorney, Agent, or Firm*—Richard C. Litman

[57] ABSTRACT

A plastic decorative and protective sheath is designed to cover jacks used to stabilize house beams, to lift and level mobile homes and the like. The jack cover comprises three basic covering parts in half-sections which are combined at the site. The parts are a capital, a column and a base. The capital and base sections are bonded with adhesive at the site to the column which is joined by tongue and groove portions.

7 Claims, 4 Drawing Sheets

FLOOR JACK COVERING DEVICE

CROSS-REFERENCE TO RELATED APPLICATION

This application claims the benefit of U.S. Provisional patent application Ser. No. 60/049,119, filed Jun. 10, 1997.

BACKGROUND OF THE INVENTION

1. Field of the Invention

The present invention relates generally to a columnar cover for an installed adjustable floor jack described as a More specifically, the invention is a decorative and accident preventive plastic sheath designed to cover adjustable jacks supporting horizontal beams, mobile homes and the like.

2. Description of the Related Art

The related art of interest describes various covers for lifting jacks, support columns and the like. The related art will be discussed in the order of perceived relevance to the present invention.

U.S. Pat. No. 4,961,358 issued on Oct. 9, 1990, to Dietrich Menzel describes a wooden (or synthetic material) decorative column consisting of equal or unequal diameter rings which have either a grooved or smooth outside surface for housing an I-beam or a table leg. If a cover is manufactured by a factory, the glued rings can be either cut into cylindrical halves or gluing stacked half-rings. The decorative columns are distinguishable for constituting permanent installations and lacking the inner protrusions for housing an extendible jack.

U.S. Pat. No. 4,606,167 issued on Aug. 19, 1986, to Parker Thorne describes a fabricated round interior column and method of construction. Fiber tube members are secured to metal framing anchored in a spaced relationship to a structural supporting column. A finish coating is troweled on and painted. The cover is distinguishable for its excessive spaced relationship to the column.

U.S. Pat. No. 5,335,471 issued on Aug. 9, 1994, to Daniel J. Kupiec describes a round column enclosing kit with a square cover comprising four rectangular cover plates anchored by collar pairs. The cover is distinguishable for its excessive spaced relationship to the column.

U.S. Pat. No. 4,467,584 issued on Aug. 28, 1984, to Crites et al. describes a method and apparatus for attaching furring to columns. A four-sided column is covered with rectangular furring by banded clips. The cover is distinguishable for its reliance on banded clips attached to the column.

U.S. Pat. No. 3,998,028 issued on Dec. 21, 1976, to John Pelletier et al. describes a furring and fireproofing protection clip assembly for attaching a partition or a duct to a support covered with a layer of fireproofing material. The cover assembly is distinguishable for its excessive spaced relationship to the duct and the required clip assembly.

Each patent presents the following problems or disadvantages: (a) requires utilization of a large number of components to be assembled about a column; (b) is not suitable for use in covering floor jacks which have protruding pins; (c) requires greater then desired levels of weight; (d) requires greater than desired levels of expense in materials and labor in assembling; and/or (e) requires greater than desired amounts of total volume thereby utilizing excessive enclosure space.

Consequently, there is a need and desire to provide a system for encasing floor jacks which utilizes a minimal amount of labor, weight of materials, volume of materials, relatively easy and inexpensive to assemble, a non-twisting cover vis-a-vis the floor jack, and yet be decorative.

None of the above inventions and patents, taken either singularly or in combination, is seen to describe the instant invention as claimed. Thus, a floor jack covering device solving the aforementioned problems is desirable.

SUMMARY OF THE INVENTION

The present invention relates to a columnar floor jack cover or enclosure having only six sections which fit tightly against and are secured to an adjustable floor jack supporting a structure. The plastic enclosure comprises a capital element, a shaft element and a base element, each of which consist of half-sections. The base element is bonded around the base of the jack. The shaft element can be shortened on site and clamed together around a spacer to provide a stable jack cover. The shaft element is bonded to the base element. The capital element sections are bonded together and bonded to the shaft element to complete the fabrication of the floor jack cover.

Accordingly, it is a principal object of the invention to provide an economical, easily assembled, protective, and decorative floor jack cover.

It is another object of the invention to provide a columnar floor jack cover comprising a capital, a shaft, and a base from six sections.

It is a further object of the invention to provide a columnar floor jack cover with internal ribs for engaging compressible spacer rings to prevent movement of the jack cover.

Still another object of the invention is to provide a columnar floor jack cover which can be assembled with adhesive for joining the capital and base halves together and to the shaft.

Yet another object of the invention is to provide a columnar floor jack cover wherein the shaft halves are joined by tongue and groove portions having interlocking beads and grooves.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
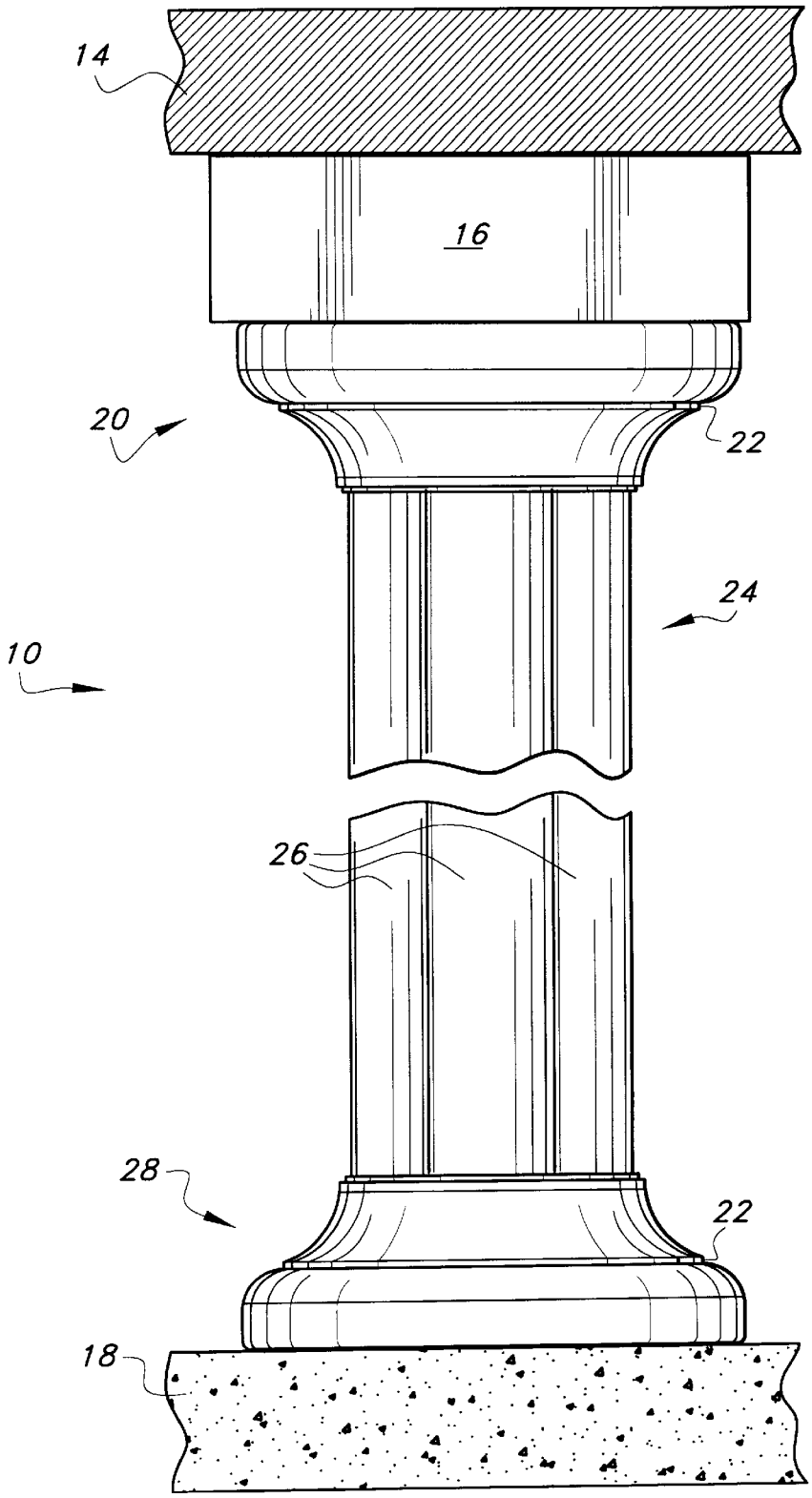
FIG. 1 is a an environmental side elevational view of the columnar floor jack cover around a floor jack (hidden) in use in a house basement according to the present invention.

In FIG. 1, a columnar floor jack cover 10 is illustrated surrounding a hidden floor jack 12 (FIG. 2) and supporting a metal joist or beam of a building, mobile home or the like structure 14. The jack 12 is shown with an optional wood or metal block 16 on top and based on a stable ground 18. Starting from the top, the jack cover 10 comprises an inverted bell-shaped capital element 20 with a circumferential groove 22, a cylindrical shaft element 24 with flutes 26, and a bell-shaped base element 28. It should be noted that the respective capital and base elements 20, 28 are identical.

Figure 2:
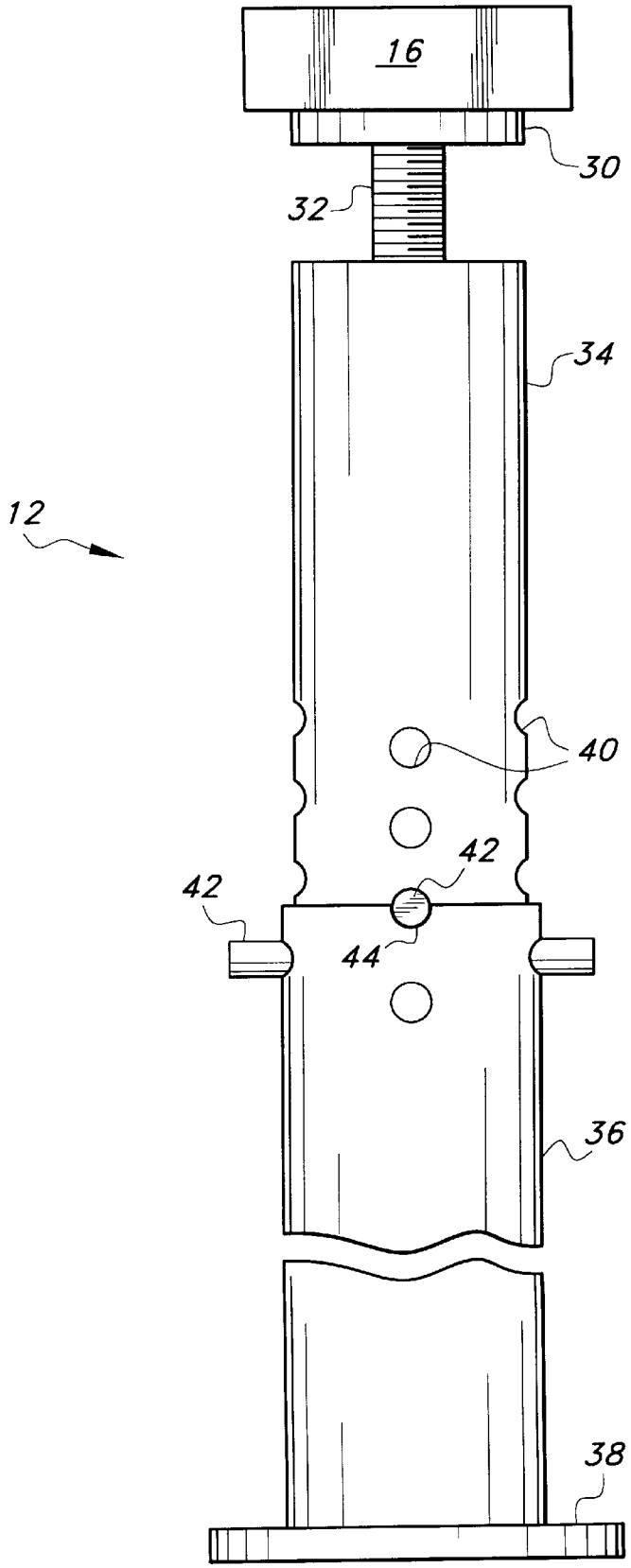
FIG. 2 is a side elevational view of a conventional jack.

FIG. 2 depicts a conventional metal floor jack 12 having a threaded extension rod 32 supporting a circular flat head 30 abutting the block 16. An upper tube 34 slidingly fits telescopically within the lower tube 36 which has a base 38. The upper tube 34 has a series of aligned throughbores 40 through which a metal pin 42 traverses and is secured in a semicircular notch 44 in the top of the lower jack tube 36, or the pin 42 may be undercut to rest on top of lower jack tube 36. Another pin 42 traverses a set of throughbores 40 in the upper and lower tubes 34, 36, respectively as shown. It should be noted that the pairs of horizontal throughbores 40 that are positioned in a vertical series in each tube 34 and 36 are offset by 90°.

Figure 3:
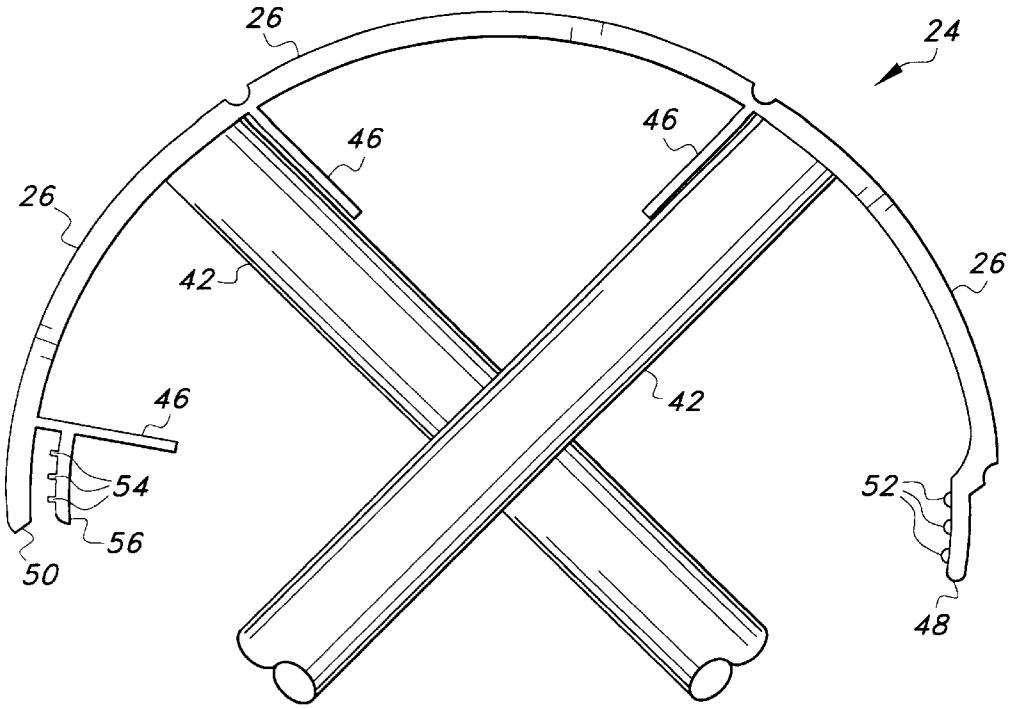
FIG. 3 is a sectional view of the FIG. 1 enclosure showing the positions of the jack pins (without the jack) abutting the internal ribs of one shaft half and the interlocking tongue and groove elements with bead and groove interlocking regions.

This arrangement of pins 42 is critical to abut the inside of the shaft element 26 to prevent twisting of the cover 10 as shown in FIG. 3. A half-section of a shaft element 24 is shown as viewed from above. Three ribs 46 project inwardly for preventing the movement of the pair of crossed pins 42 the jack tubes (not shown for clarity) and thus the cover 10. Each half-section of the shaft element 24 has a tongue portion 48 at one end and a groove portion 50 on the opposite end positioned on a rib 46. The tongue portion 48 has a series of linearly arranged beads 52 which interlock with the linearly arranged squared off ridges 54 of the flange 56 on the tongue portion 48. This locking arrangement provides an efficient and time-saving method of joining the half-sections of the shaft element 24 by beginning at the bottom, and in effect zipping up the shaft element 24 with a compression fitting.

Figure 4:
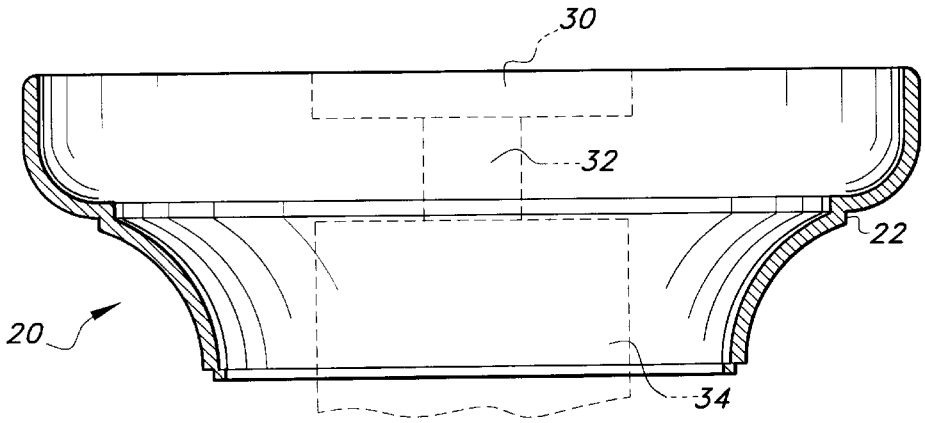
FIG. 4 is a side view of one half section of a capital.

Turning to FIG. 4, a cross-section of a capital element 20 is depicted. Although, no drawing of the base element 28 is shown, the external configuration is identical to that of the capital element 20. Internally, inside walls of capital element 20 and base element 28 are cylindrical, and the half sections of each are glued together at their adjoining edges.

Figure 5:
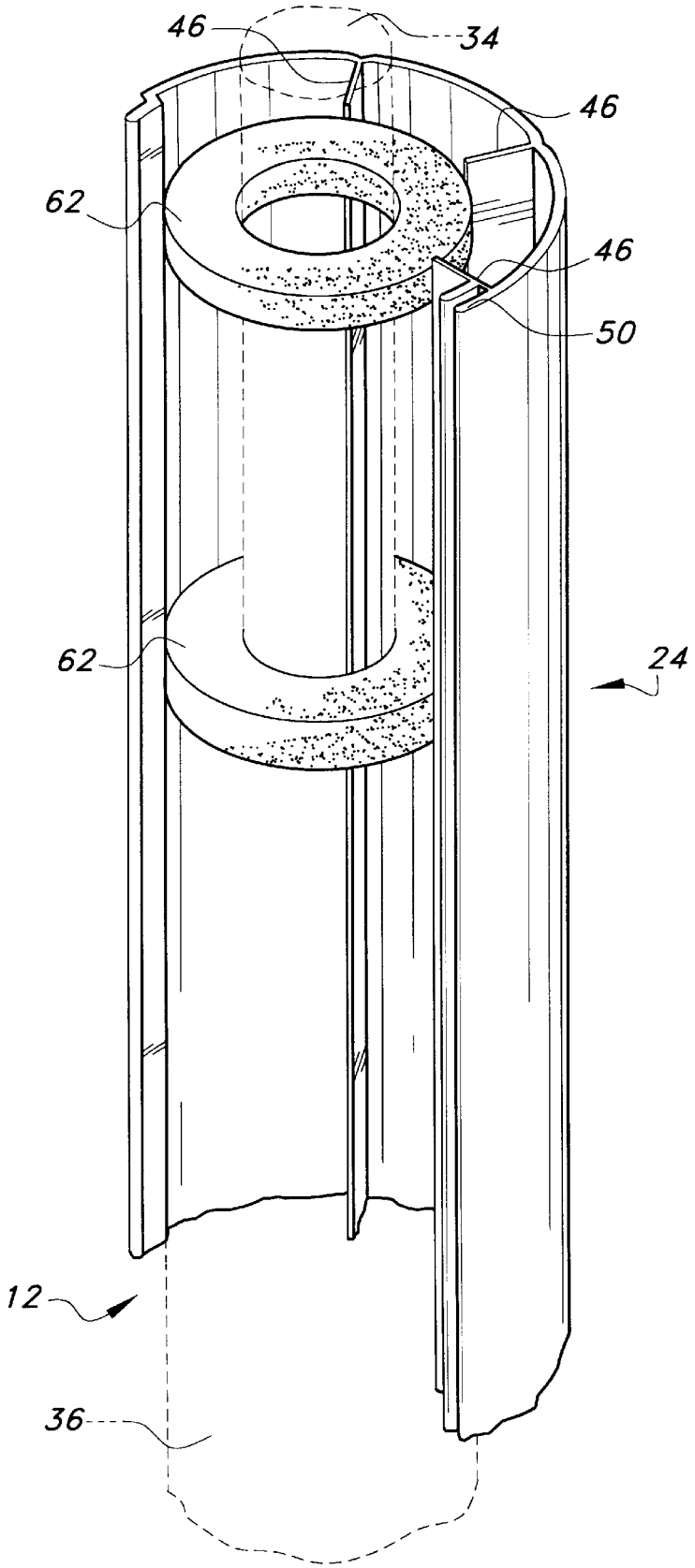
FIG. 5 is a an exaggerated, partial perspective view of one half-section of a column showing a compressible spacer on a jack abutting the ribs of the shaft.

FIG. 5 illustrates how the upper part of cylindrical shaft element 24 is stabilized about upper jack tube 34. At least one resilient spacer ring 62, preferably made of rubber, surrounds upper jack tube 34. When the two half-sections of the jack cover 10 are secured together, ribs 46 engage the outer periphery of resilient ring 62 to prevent any movement of the cylindrical shaft element 24. The inner periphery of resilient ring 62 may include an adhesive to further retain the ring around the upper jack tube 34. As shown in FIG. 5, each rib 46 projects inwardly from the interior surface of shaft element 24 and extends longitudinally along its length.

The method of installing the floor jack cover 10 around a floor jack 12 is as follows. First, the two half-sections making up the two longitudinal halves of the shaft element 24 are cut to the length measured from floor to ceiling at the location of the jack being covered. Then, the at least one compressible ring 62 is placed around the upper half 34 of the floor jack. Next, the two halves of the shaft element 24 are placed around the floor jack, assuring that the ribs 46 are trapped between the pins 42, as seen in FIG. 3, and the cover halves are snap-fit together about the jack. Finally, glue is applied to the adjoining edges of the respective mating halves of the capital 20 and base 28, and these halves are placed about the top and bottom of the shaft element 24. The installation is now complete.

Although, an example of covering a floor jack has been presented, it is within the ambit of the present invention that pipes, posts and the like can be covered with the decorative and economical cover of the present invention, and utilizing one or more of the stabilizing spacers as discussed above, internally of the cover.

Thus, an economical, decorative and protective cover for floor jacks and the like has been shown.

It is to be understood that the present invention is not limited to the embodiments described above, but encompasses any and all embodiments within the scope of the following claims.

I claim:

1. A columnar cover for an adjustable jack comprising:

a cylindrical shaft element formed of interlocking half-sections, said shaft element having a top region and a bottom region, each of said half-sections including an interior surface and a plurality of spaced-apart ribs projecting inwardly from the interior surface and extending substantially along its length;

a capital element surrounding and connecting said cylindrical shaft element about the top region, said capital element being formed from two bonded together half-sections;

a base element surrounding and connecting said cylindrical shaft element about the bottom region, said base element being formed from two bonded together half-sections; and a least one resilient spacer ring disposed within said cylindrical shaft element proximate the top region, said at least one ring being adapted to surround an adjustable jack and engaging said plurality of ribs to prevent movement of the cover.

2. The columnar cover according to claim 1, wherein said cylindrical shaft element has a fluted exterior surface.

3. The columnar cover according to claim 1, wherein the said shaft element, said capital element and said base element are made from plastic.

4. The columnar cover according to claim 3, wherein the plastic is a polyvinyl chloride resin.

5. The columnar cover according to claim 1, wherein each of said cylindrical shaft half-sections includes a tongued edge and a mating grooved edge for interlocking the half-sections together.

6. The columnar cover according to claim 1, wherein said capital element has an inverted bell-shaped external configuration.

7. The columnar cover according to claim 1, wherein said base element has a bell-shaped external configuration.

* * * * *